US005090975A

United States Patent [19]

Requejo et al.

[11] Patent Number: 5,090,975

[45] Date of Patent: Feb. 25, 1992

[54] HIGH EFFICIENCY VACUUM CLEANER BAGS

[75] Inventors: Luz P. Requejo; John P. Chua, both of Cincinnati, Ohio

[73] Assignee: The Drackett Company, Cincinnati, Ohio

[21] Appl. No.: 586,615

[22] Filed: Sep. 21, 1990

[51] Int. Cl.[5] ..... B01D 46/02

[52] U.S. Cl. ..... 55/97; 55/367; 55/374; 55/381; 55/528

[58] Field of Search ..... 55/367, 374–377, 55/381, 382, 486, 527, 528, 97

[56] References Cited

U.S. PATENT DOCUMENTS

| | | | |
|---|---|---|---|
| 2,909,238 | 10/1959 | Lofgren | 55/382 |
| 3,755,993 | 9/1973 | Cote | 55/381 X |
| 3,859,064 | 1/1975 | Cordell | 55/382 X |
| 3,890,125 | 6/1975 | Schoeck | 55/381 |
| 3,942,963 | 3/1976 | Tevis | 55/381 X |
| 4,352,684 | 10/1982 | Amberkar | 55/382 |
| 4,589,894 | 5/1986 | Gin et al. | 55/382 X |
| 4,802,900 | 2/1989 | Ball et al. | 55/381 |
| 4,917,942 | 4/1990 | Winters | 55/486 X |

FOREIGN PATENT DOCUMENTS 0292285 11/1988 European Pat. Off. .

*Primary Examiner*—Robert Spitzer
*Attorney, Agent, or Firm*—Charles J. Zeller

[57] ABSTRACT

A novel vacuum cleaner bag is disclosed comprising a closed receptacle having an inlet orifice, the bag being formed from a sheet containing at least 65% flashspun polyolefin fibers. The vacuum cleaner bag is suitable for conventional vacuum cleaners and provides efficient removal of particulate matter, especially soil particles less than 10 microns in size.

26 Claims, 6 Drawing Sheets

INCREASE IN VACUUM EXHAUST PARTICLE POPULATION × 10 3
350
300
250
200
150
100
50
0
HOOVER
FMB
P-161
P-16
>0.3
>0.5
>0.7
>1.0
>5.0
>10.0
PARTICLE SIZE IN POPULATION (μ)

HIGH EFFICIENCY VACUUM CLEANER BAGS

FIELD OF INVENTION

The present invention concerns novel vacuum cleaner bags suitable for use in conventional vacuum cleaners and adapted to provide efficient removal of particulate matter commonly found in carpets, floors made of wood, linoleum, plastic tile, ceramic tile, etc., upholstery, drapes and the like. More specifically, the present invention relates to vacuum cleaner bags especially adapted to capture particles as small as 1 micron, or even smaller, that are present on the aforementioned surfaces. Most specifically, the present invention concerns vacuum cleaner bags fabricated from flashspun polymeric materials, especially polyolefins, in particular polyethylene.

BACKGROUND OF THE INVENTION

Traditionally, vacuum cleaner bags have been fabricated from a relatively porous cellulosic, i.e., paper, substrate. Vacuuming efficiency is good with such paper vacuum bags, that is, the soil is removed from the surface being vacuumed. However, vacuuming efficiency, according to this definition, is more a function of the vacuum force generated by the vacuum cleaner than a measure of vacuum bag performance.

The paper substrates are sufficiently porous to permit an air flow through the clean bag of about 25 to 50 cubic feet per minute (cfm) per square foot of substrate and are adequate to retain particulate matter of above 10 microns. This accounts for most of the weight of the soil to be vacuumed. However, because the paper vacuum bag is porous, the smaller particles initially pass through the paper vacuum bag medium. As a result, the smaller particles, that is, "dust," is exhausted into the air from the vacuum itself. This can be observed by viewing the exhaust of the vacuum backlighted by sunlight. Indeed, it is not uncommon for there to be dust covering furniture in a room previously dusted prior to vacuuming.

During use, the pores of the paper vacuum bag become plugged with particles of dirt. As one might expect, the plugging of the pores of the paper vacuum bag assists in capture of the smaller particles. However, this occurs only after several uses of the vacuum, and often when the bag has been filled to a significant degree. Moreover, at least until the paper vacuum bag is quite plugged, the inherent porosity of this filter medium permits the particles entrapped in its pores to be dislodged and replaced by similarly sized particles, a phenomenon known as seepage penetration The effect, then, is the same—the smaller particles are exhausted into the atmosphere.

The reentry of small particles of less than about 10–20 microns into the vacuumed room is, of course, irksome because the room has not been cleaned meticulously. However, the particles of less than about 20 microns include pollen (about 20 microns), skin scale (about 15 microns), spores (0.25 to 3 microns), fungi (about 2 microns), bacteria (0.25 to 2 microns) and fair amounts of dust (5–100 microns). These air contaminants cause serious allergies or occasion the transmittal of various diseases, e.g., flu. Accordingly, the removal or reduction of such finely sized contaminants from the vacuumed surface without releasing them through the vacuum cleaner exhaust is particularly desirable. Indeed, these particles are better left on the surface being vacuumed than releasing them into the atmosphere.

Attempts have been made to provide vacuum cleaner bags which are better in retaining the smaller particles within the bag, and not exhausting them into the atmosphere.

Thus, U.S. Pat. No. 4,589,894 to Gin discloses a vacuum cleaner bag of three ply construction comprising (a) a first outer support layer of highly porous fabric formed of synthetic fibers, the fabric having an air permeability of at least 100 $m^3/min/m^2$; (b) an intermediate filter layer formed of a web comprising randomly interentangled synthetic polymeric microfibers that are less than 10 microns in diameter, has a weight of 40 to 200 $g/m^2$, and an air permeability of about 3 to 60 $m^3/min/m^2$, and (c) a second outer support layer disposed on the opposite side of the web having an air permeability of at least 50 $m^3/min/m^2$. The web of the Gin vacuum cleaner bag may be made by melt-blown or solution-blown processes. Illustratively, the Examples 1–7 in Gin describe use of melt-blown polypropylene as the web ply and nylon or spun-bonded polypropylene as the support plys.

Another multiply filter medium useful for vacuum cleaner bags is disclosed in U.S. 4,917,942 to Winters. The laminate structure of Winters comprises a porous layer of self-supporting nonwoven fabric having an air permeability of 300 $m^3/min/m^2$ and a layer of randomly intertangled nonwoven mat of electret-containing microfibers of synthetic polymer coextensively deposited on and adhered to the self-supporting nonwoven fabric. The self-support layer is, preferably, a spun-bonded thermoplastic polymer. The electret-containing mat is preferably based on a melt-blown polyolefin.

The melt-blown polyolefin fiber webs used by Gin and Winters as the filter medium are disadvantageous in that they have little structural strength. Thus, they are characterized by poor tensile and tear strengths, and cannot be fabricated into a usable vacuum cleaner bag independent of the supporting scrims. This adds to the cost of the vacuum cleaner bag, which is, of course, undesirable. Moreover, these fibers do not lend themselves to vacuum cleaner bag fabrication utilizing the type of equipment used commonly in the manufacture of vacuum cleaner bags.

It has been found that a vacuum cleaner bag characterized by excellent retention of small particles of 10 microns or less can be fabricated from a sheet of flashspun polyolefin fibers. This flashspun sheet, described in greater detail below with respect to its manufacture and properties, has excellent strength. Accordingly, vacuum cleaner bags of the present invention can be fabricated from a sheet of this material, and without the requirement for a supporting scrim. Moreover, this material, which comprises ultra-short fibers of micro diameter, can be fabricated into a nonwoven substrate with a process analogous to the manufacture of cellulosic substrates, which account for the majority of vacuum cleaner bags currently sold. Advantageously, these flashspun sheets have a uniform effective pore size distribution which permits their utilization as a vacuum cleaner bag without substantial decay in air permeability throughout its normal use—i.e., until the vacuum cleaner bag of the present invention has been essentially filled.

SUMMARY OF INVENTION

It is an object of the present invention to provide a vacuum cleaner bag fabricated from a sheet of flashspun polyolefin.

It is a further object of the invention to provide a vacuum cleaner bag that is suitable to enhance retention of small particles less than 10 microns in diameter, and in particular up to about 1 micron or even less in diameter, within the vacuum cleaner bag.

It is a primary object of the present invention to provide a vacuum cleaner bag adapted to reduce appreciably the population of particles between 1 to 10 microns present in the outlet air leaving the vacuum cleaner, that is, to capture and retain such particles in the vacuum cleaner bag.

These and other benefits and advantages of the invention will be more fully understood upon reading the detailed description of the invention, a summary of which follows.

The vacuum cleaner bags of the present invention are suitable for use with a vacuum cleaner device or system having a vacuum inlet tube attachable at one end to the vacuum cleaner bag. The vacuum cleaner bag comprises a closed receptacle having a vacuum inlet tube attachment orifice, the receptacle being formed from a sheet containing at least 65% ultra-short flashspun polyolefin fibers, and means affixed to the receptacle for attachment of the vacuum inlet tube within the orifice. Preferably, the vacuum cleaner bags comprise a sheet containing more than 75% of the ultra-short flashspun fibers, most preferably more than 90% of such fibers. In particular, the vacuum cleaner bags of the present invention are fabricated from a sheet comprising essentially 100% ultra-short flashspun fibers.

The vacuum cleaner bag is characterized by having such strength as to permit its construction from the flashspun polyolefin sheet and not to require further structural support such as a scrim joined to the sheet. The flashspun sheet is also sufficiently durable as to resist undue wearing during normal vacuuming. The flashspun polyolefin sheet material from which the vacuum cleaner bag is made has an air permeability, when new, of at least about 2, preferably 5-20, most preferably 5-12 cfm/ft$^2$. It has been found that the vacuum cleaner bags of the present invention are especially resistant to plugging or blinding by small-sized particles. Accordingly, the vacuum cleaner bags retain sufficient air permeability during vacuuming to maintain their cleaning capability until the vacuum cleaner bag is essentially full.

DETAILED DESCRIPTION OF THE INVENTION

Figure 1:
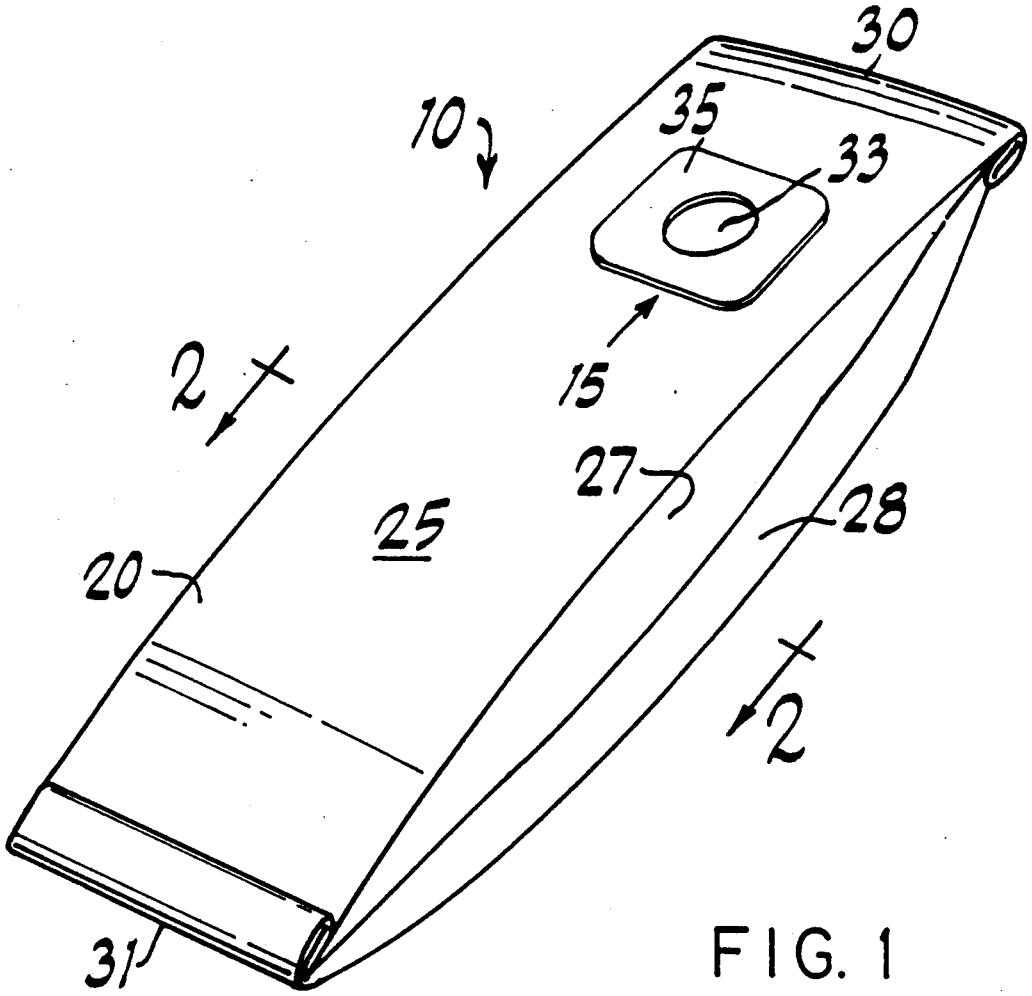
FIG. 1 is a perspective view of a vacuum cleaner bag suitable for use with an upright, top fill vacuum.

The vacuum cleaner bag of the present invention employs as the filter medium a sheet made from flashspun polyolefin fibers, the sheet being characterized by its ability to effectively reduce the level of small sized dirt particles, including dust, spores, pollen, fungi, etc., vacuumed from a surface. Typically, the dirt particles of interest have a size in the range of less than about 10 microns, with particles of 1 to 10 microns being especially difficult to remove with conventional paper vacuum cleaner bags. Indeed, the vacuum cleaner bags of the present invention have been found to be effective with respect to even smaller sized particles.

Moreover, the flashspun polyolefin sheets are further characterized by their strength. Accordingly, the vacuum cleaner bags of the present invention do not require a supporting scrim, which only serves to multiply the number of processing steps needed during manufacture.

The flashspun fibers suitable for use in the manufacture of the vacuum cleaner bags of the present invention are made by preparing a mixture of volatile solvent and molten polyolefin polymers, which mixture is forced through an extruder with subsequent rapid evaporation of the solvent to produce relatively continuous polyolefin fibers having a micro-fine fiber diameter distribution in the range of 0.5 to 20 microns. These continuous fibers are then refined to provide ultra-short fibers. Suitably, these fibers have a length of less than about 6, preferably from about 0.5 to about 2 mm. The ultra-short fibers are then dispersed in water to form a slurry, which slurry is deposited on a Fourdrinier or inclined wire. The slurry also contains a low concentration, from about 0.1 to about 5%, of a binding agent such as polyvinyl alcohol. A sheet of relatively low strength is obtained by virtue of the mechanical entanglement of these ultra-short, small-diameter fibers, upon removal of the water and drying. Thereafter, the flashspun fiber sheet is further treated by a hot bonding procedure, which, due to the thermal joining of at least a portion of the fibers, imparts significant strength to the flashspun fiber sheet. It is Applicants' understanding that the process for forming flashspun polyolefin sheets as described above is set forth in EPA 292,285 assigned to DuPont, published Nov. 23, 1988, incorporated herein by reference thereto.

It is seen that the latter portion of the process wherein the flashspun fiber sheet is made is analogous to conventional paper making. Accordingly, existing or modified processing equipment is suitable and processing is within the understanding of existing personnel.

The former portion of the process—the preparation of the short fibers—is quite advantageous in certain respects. First, the refining process provides control over the length of the fibers to be used in manufacture of the flashspun sheet. Second, and collaterally, the shortness of the fibers obtained considerably increases the uniformity, and hence the strength of the sheet produced. Unlike meltblown webs, which comprise rather long fibers, the flashspun fibers can network in three dimensions in view of their ultra-short length. The third, most critical benefit, is the very high fiber surface area per unit weight of fiber afforded the sheet by the processing. Thus, the flashspun fibers in the sheet have a fiber surface area per unit weight of at least about 2, preferably at least about 2.5, most preferably at least about 3.5 $m^2/g$. In comparison, the fibers present in a typical meltblown polyolefin web has a surface area per unit weight of fiber of less than about 1.5 $m^2/g$.

In considering the flashspun polyolefin sheets for their suitability as the construction material for a vacuum cleaner bag, various parameters were identified that affect cleaning efficiency. In particular, the ability of the flashspun sheets to substantially remove particles in the <10 micron range was investigated.

Thus, it is believed that the particle capture efficiency was improved with the vacuum cleaner bags of the present invention in view of their particularly effective pore size distribution of substantial uniformity across the surface of the sheet. In defining this parameter, the term "effective" is used, inasmuch as the pores are irregular in geometry. The effective pore size distribution, in turn, is a function of fiber diameter and fiber length, which together define fiber surface area of a given weight of fiber.

Suitable diameter, length and surface area characteristics of the fibers used to make the flashspun sheet material used in the manufacture of the vacuum cleaner bags of the present invention, are tabulated below:

TABLE I

| | Broad | Preferred | Most Preferred |
|---|---|---|---|
| Fiber diameter distribution, μ | 0.5–20 | 0.5–15 | 0.5–10 |
| Fiber length, mm | 0.1–6.0 | 0.5–2.0 | 0.5–1.5 |
| Fiber surface area, $m^2/g$ | >2 | >2.5 | >3.5 |

As a practical matter, fiber surface areas above about 6 $m^2/g$ are difficult to achieve. However, this should not be regarded as an upper limit, inasmuch as increasing fiber surface area improves particle capture efficiency.

Each of these fiber parameters affect particle capture efficiency. Thus, particle capture efficiency has been found to increase with decreasing fiber length and decreasing fiber diameter, which increases fiber surface area for a given weight of fiber present in the sheet. These parameters influence the effective pore size distribution of the sheet.

Table II, below, sets forth the effective pore size distribution of the flashspun sheets as measured by a Coulter Porometer. Moreover, the pores of the flashspun sheet are especially uniform over their surface.

TABLE II

| Effective Pore Size Distribution, μ | Cumulative Percent | | |
|---|---|---|---|
| | Broad | Preferred | Most Preferred |
| >30 | 1 | 0.1 | 0 |
| >20 | 5 | 2 | 0.5 |
| >10 | 90 | 50 | 2.5 |
| <10 and above | 100 | 100 | 100 |

The caliper of the flashspun sheet for use in the vacuum cleaner bags of the present invention is from about 5 to about 25, preferably from about 8 to about 15 mil. Below a caliper of about 5 mil, the strength of the of the flashspun sheet is usually too low for the construction of a "stand-alone" vacuum cleaner bag, that is, a vacuum cleaner bag in which a support scrim is unnecessary. Above about 25 mil, the caliper of the web is too high, and may negatively affect the air permeability of the sheet.

The vacuum cleaner bag material, when clean, should have an air permeability of at least about 2 $cfm/ft^2$. Preferably, air permeability is in the range of 5 to 20 $cfm/ft^2$, most preferably 5 to 12 $cfm/ft^2$. An air permeability of less than about 2 cfm is deemed to be the lower practical limit for vacuum cleaner bags for use with household vacuum cleaners. Thus, at such air permeability, the motor of the vacuum must overcome the higher pressure drop through the vacuum cleaner bag. Above about 25 cfm air permeability, the sheet is too porous to effectively remove the smaller particles of less than about 10 microns.

The lower portion of the air permeability range is significantly lower than that typically considered necessary for the conventional paper vacuum cleaner bag. This is because the large pores of the conventional paper vacuum cleaner bags are prone to blinding, that is, plugging. Thus, during use, there is a decay in the porosity of the paper vacuum cleaner bags with resulting decrease in air permeability. The vacuum cleaner bags of the present invention, made with the flashspun sheet as previously indicated, appear to be substantially less prone to blinding during use. That is, Applicants have experienced no reduction in the ability of the vacuum cleaner bags to pick up debris from the surface being vacuumed until the vacuum cleaner bag is essentially full. This is surprising inasmuch as the clean vacuum cleaner bag of the present invention has an inherently low air permeability. Thus, it is believed that the air permeability of the vacuum cleaner bags of the present invention is relatively constant with use during the normal life of the bag—i.e., until the bag is full. Of course, the pressure drop through the vacuum cleaner bag does increase as the bag fills because of the loss in bag surface area attributable to filling.

Tests with meltblown vacuum cleaner bags have indicated that they are appreciably less resistant to blinding as compared to the flashspun sheet and somewhat less resistant to blinding as compared to paper. Furthermore, because the meltblown webs are inherently weak, it is important to minimize wear occasioned by high pressure differentials across the surface of such web. Accordingly, it is disadvantageous to use meltblown webs having a low air permeability. On the other hand, the flashspun material has excellent strength and wear resistance, and poses no difficulty, notwithstanding a possibly low air permeability.

In addition, the flashspun material employed in the manufacture of the vacuum cleaner bags of the present invention has other properties which are desirable. Thus, the flashspun sheet has a low surface coefficient of friction, which is one factor that makes it resistant to blinding. Further, the flashspun material is hydrophobic. Accordingly, it has good wet strength. Thus, the inadvertent suction of spills or vacuuming of damp carpets is less likely to damage the vacuum cleaner bag.

The typical properties of the flashspun sheet used to make the vacuum cleaner bags of the invention are reported in Table III.

TABLE III

| | Test Method | Range | Preferred |
|---|---|---|---|
| Mullen Bursting Strength, psi | ASTM D 774 | >15 | 30–50 |
| Tongue Tear, lb/in | ASTM D2261 | >0.05 | 0.1–0.3 |

TABLE III-continued

| | Test Method | Range | Preferred |
|---|---|---|---|
| Break Strength, lb/in | ASTM D1682 | >10 | 15-25 |
| Elongation, % | ASTM D1682 | >3 | 5-20 |
| Puncture Resistance, lb-in/in$^2$ | ASTM 3420 | >3 | 6-10 |
| Surface Coefficient of Friction (Slip Angle), degrees | TAPPI T 503 | <50 | <40 |

Each of these properties provide for an exceptionally useful material for use in the vacuum cleaner bags of the present invention.

The vacuum bags may be fabricated in the myriad of geometries needed for the various types and models of vacuum cleaners. The two principal types of vacuum cleaners are the upright and canister types. The upright vacuum cleaner uses an elongated vacuum cleaner bag, while the canister vacuum cleaner uses a short bag that is generally somewhat longer than it is wide. Vacuum cleaner bags suitable for a central vacuum system may also be made.

The upright comes in two styles—a top fill bag having a vacuum inlet tube connection opening proximate the top of the bag, and a bottom fill wherein one end is open for connection to the vacuum inlet tube located proximate the bottom of the vacuum cleaner. Generally, the upright type of vacuum cleaner also has a porous outer bag made of vinyl, cloth or vinyl-coated cloth, the vacuum bag residing therewithin. The outer bag serves as protection for the vacuum cleaner bag, and does not participate to any significant degree in the capture of the soil particles. In some models, especially older models, the upright vacuum has a "blow-back" feature, which permits the air stream entering the vacuum to bypass the vacuum bag. In most newer models, the motor is protected by a trip switch which shuts off the motor, as when the inlet tube is clogged or the bag is completely full.

Figure 2:
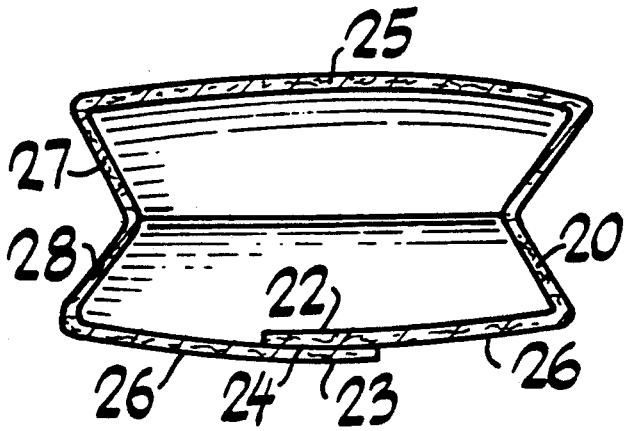
FIG. 2 is a cross-sectional view across cross-section lines 2—2 of FIG. 1.

FIGS. 1 and 2 illustrate a top fill vacuum cleaner bag 10 suitable for use with an upright vacuum cleaner.

The upright bag 10 is a receptacle of unitary construction comprising a single sheet 20 of the flashspun polyolefin material, as best illustrated in FIG. 2. FIG. 2 is a cross-sectional view of the bag shown in FIG. 1, across lines 2—2. The caliper or thickness of the sheet 20 shown in FIG. 2 has been greatly enlarged in order to clearly illustrate the construction of the bag 10. The single sheet 20 is formed into an elongated cylinder by joining the ends 22 and 23 of sheet 20 along their length at interfacial surface 24. Sufficient sheet material is retained between sidewall surfaces 25 and 26 to permit formation of one or more pleats or gussets. In the bag shown in FIGS. 1 and 2, a single gusset is illustrated, formed by sidewall segments 27 and 28. It is more typical, however, for a bag to have two such gussets. The ends 22 and 23 may be joined by a conventional means, for example, adhesively, thermally, or mechanically.

As best shown in FIG. 1, the top and bottom ends 30, 31 of the bag 10 are closed simply by wrapping an end over itself, and joining the wrapped ends to the front surface 25 or rear surface 26 of the bag. The bag 10 is a top fill type. Accordingly, the vacuum inlet tube connection shown generally by numeral 15 is proximate to the top of the bag. The connection comprises an orifice 33 through the bag and a collar 35 joined to the front surface 25 of the bag, the collar having an opening which registers with the opening 33.

As clearly illustrated by FIGS. 1 and 2, the vacuum cleaner bag 10 is fabricated from a single sheet of the flashspun filter material, and does not require a supporting scrim or other supporting structure. This is possible in view of properties previously described for the flashspun filter material.

Figure 3:
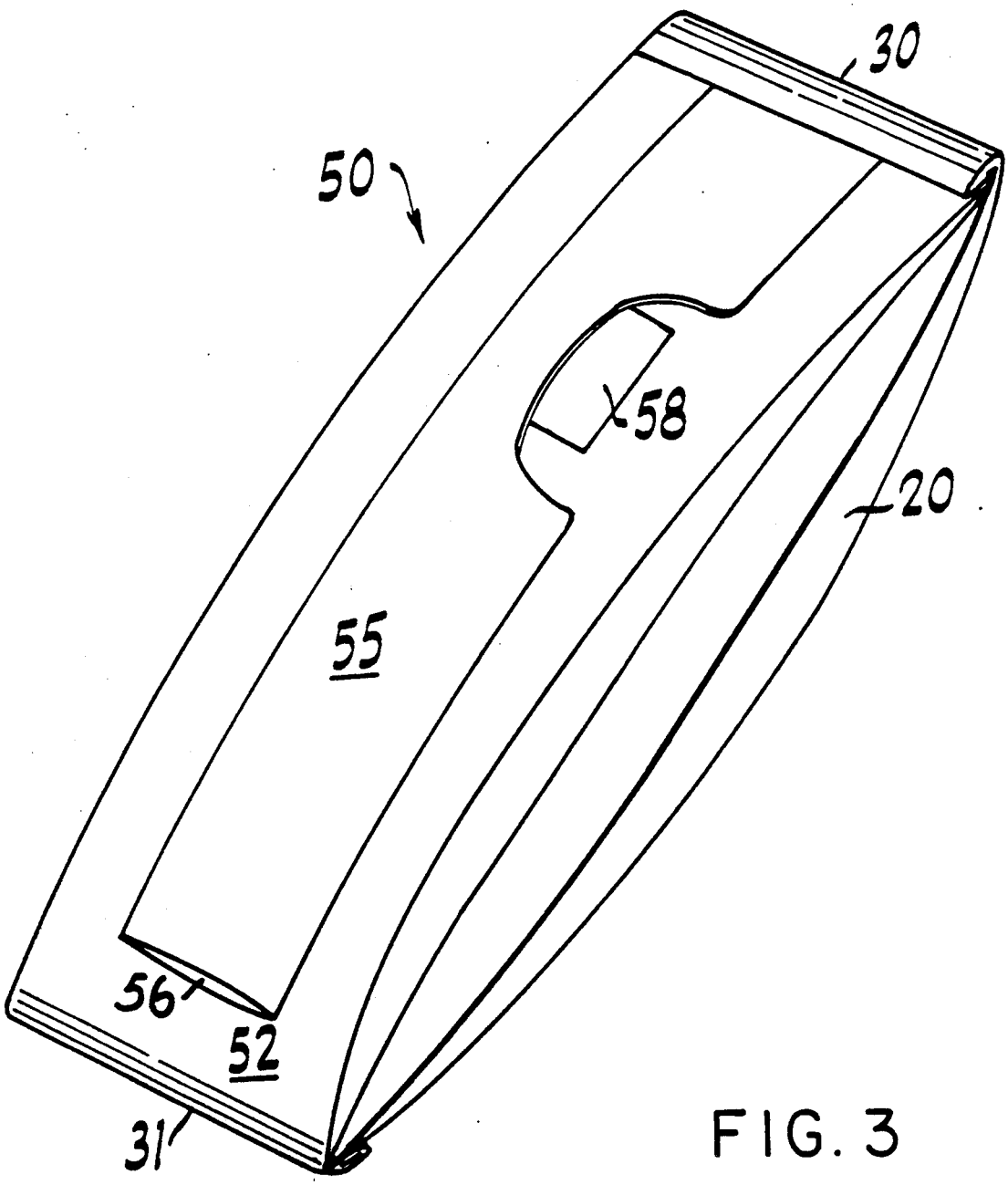
FIG. 3 is a rear perspective view of an alternate model vacuum cleaner bag suitable for use with an upright, top-fill vacuum.

Another top-fill bag 50 is illustrated in FIG. 3, in rear perspective view. The construction of this bag is similar to that of the top fill type shown in FIGS. 1 and 2, but instead of the vacuum inlet tube connection 15 shown in FIG. 1 has a sleeve 55 extending downward from a vacuum bag fill orifice 58, shown in the cutaway portion of the rear surface 52 of the bag 50. The other elements of the bag are identified by the same numerals as in FIGS. 1 and 2. The sleeve 55 is connected to the vacuum inlet tube at opening 56. The sleeve 55 may be fabricated from impervious paper or other suitable material.

Figure 4:
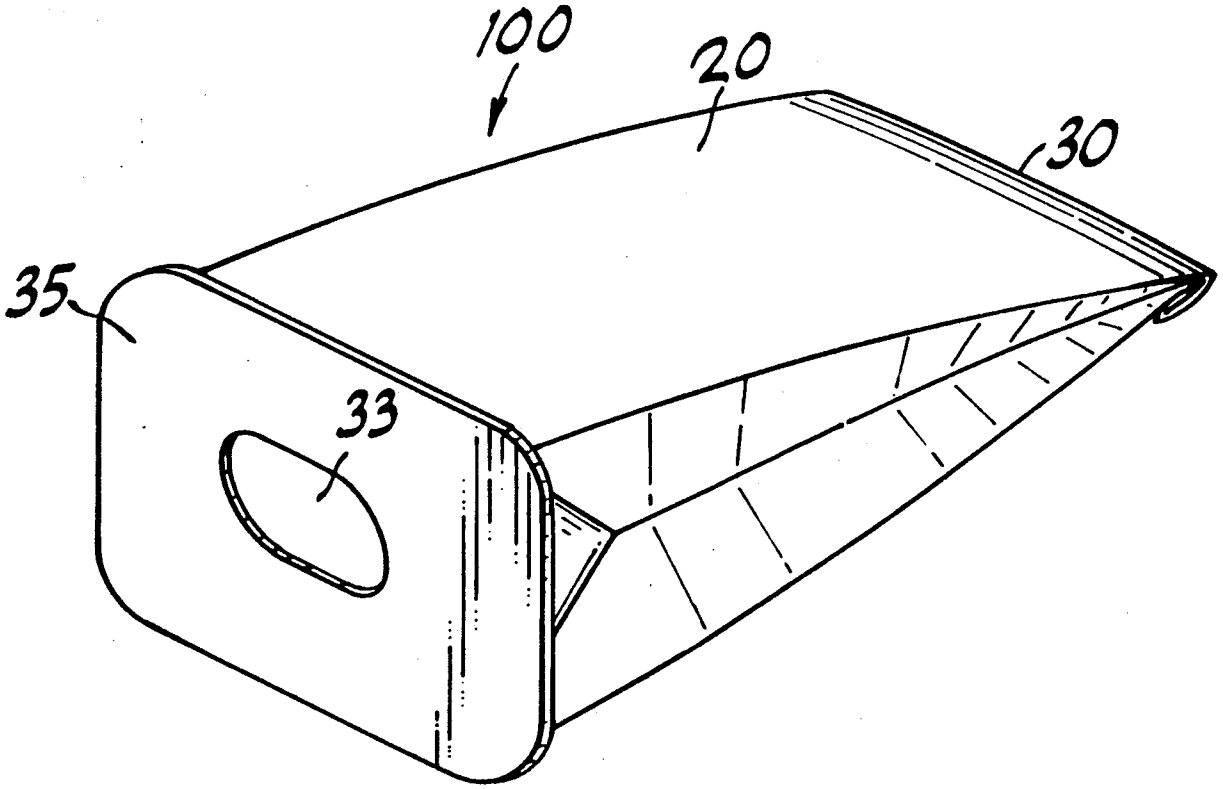
FIG. 4 is a perspective view of a vacuum bag suitable for use with a canister vacuum.

FIG. 4 illustrates a vacuum cleaner bag 100 suitable for use with canister vacuum cleaners.

The vacuum cleaner bags of the present invention may also be provided in other geometric shapes, which may be required for vacuums used by professional cleaning services. Moreover, the vacuum cleaner bags may be fabricated for reuse. Thus, in FIG. 1, for example, the bag closure at the top end 30 may be made openable by utilizing mechanical closure means, such as a zipper, snaps or the like. The bags of the present invention may be reused in view of their strength and ability not to blind.

It should be understood that the flashspun sheets described above may also contain minor amount of fibers not made by the flashspun process. Generally, the amount of such other fibers should be less than about 35% by weight of the total sheet, preferably less than 25%. For example, a sheet made containing 80% flashspun polyethylene fibers and 20% continuous filament polyester made by a spun bonding process was found to be suitable in the manufacture of the vacuum cleaner bags of the present invention. The polyester fibers increased air permeability and tensile strength of the sheet, but because this sheet also had a greater pore size distributionand air permeability, particle capture efficiency was sacrificed to some extent. Other types of nonflashspun fibers can be used, nonlimiting examples of which are polyamide and polyolefin fibers. Of course, in view the above discussion regarding efficiency, care must be used when blending these other fibers with the flashspun fibers, both as to amount and kind of the nonflashspun fibers. The preferred embodiment of the present invention, however, is a vacuum cleaner bag made from a flashspun sheet comprising very high proportions, above about 90% flashspun fibers. Most preferably, the vacuum cleaner bag is made from a sheet containing essentially 100% flashspun fibers.

It should also be appreciated that the flashspun sheet may be a composite sheet comprising two or more flashspun sheets thermally or otherwise laminated together. Other posttreatments of the flashspun sheet may also be conducted, if desired, provided that such treatments do not adversely affect the performance of the vacuum cleaning process.

Figure 5:
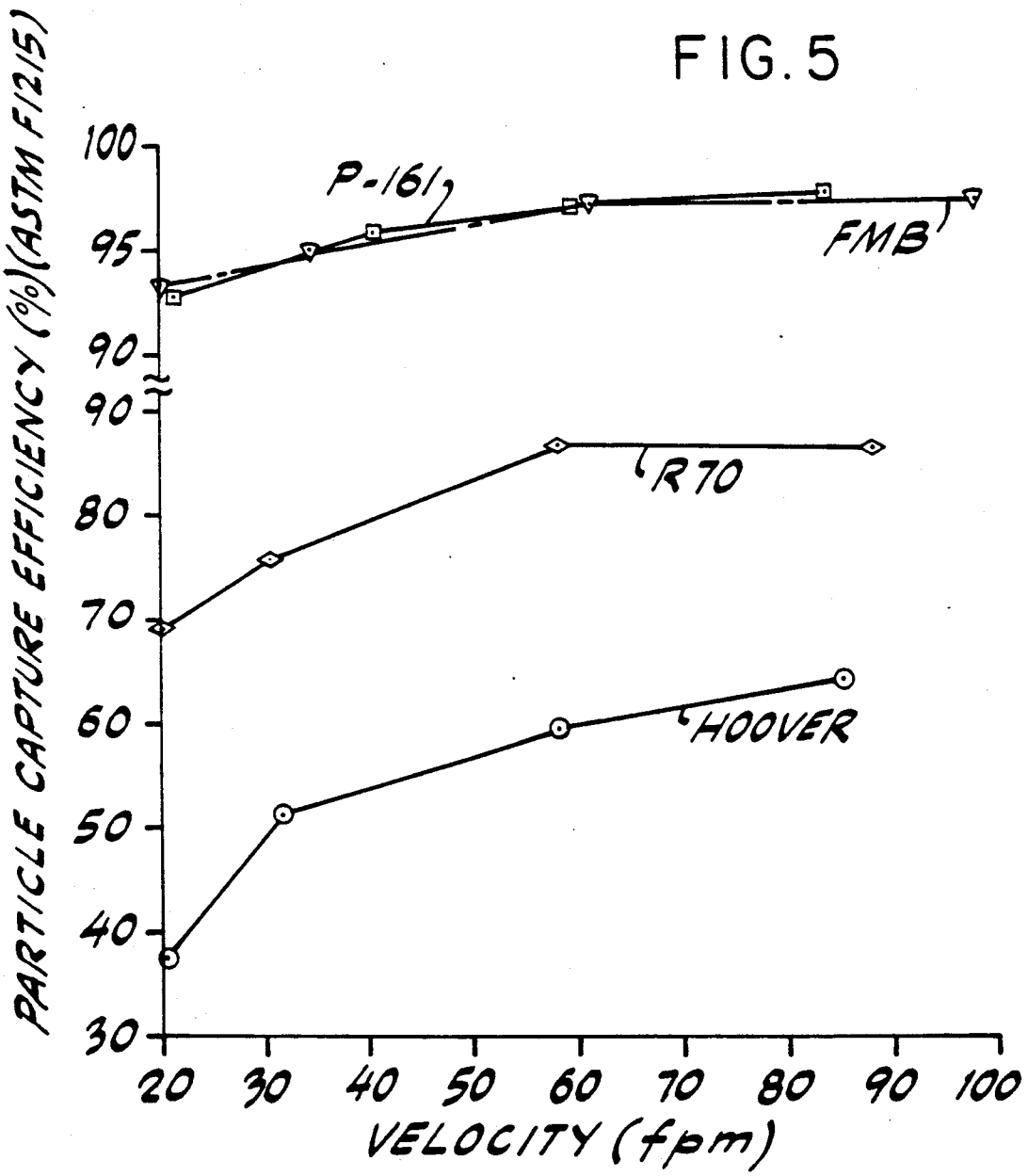
FIG. 5 is a graph illustrating particle capture efficiency as a function of velocity, for various polymeric sheet or web materials, with respect to 1 micron particles in accordance with ASTM 1215-89.

Initial tests in accordance with ASTM F 1215-89 were conducted on a flashspun polyethylene sheet. This test measured the ability of the flashspun sheet to remove one micron particles from an air stream at air stream velocities ranging from about 20 to about 100 ft/min. The exhaust from a typical vacuum, operating with a clean vacuum cleaner bag, is about 60 ft/min. The results of the initial testing for various substrates tested in accordance with the ASTM procedure are illustrated graphically in FIG. 5. The substrates tested are described in greater detail in Table IV.

The initial tests per the ASTM F 1215-89 protocol demonstrated the ability of the flashspun sheet to remove about 98% of the one micron particles. This compared favorably to paper (as obtained from a commercial Hoover top fill upright cleaner bag), which removed only about 60% of the one micron particles at 60 ft/min and a fine meltblown web (FMB) which removed about 82% of the one micron particles. A sheet comprising 80% flashspun fibers and 20% polyester fibers (R-70) was able to remove about 86% of the one micron particles at 60 ft/min air velocity.

This test could not, however, predict the suitability of the flashspun sheet for its intended purpose as a vacuum cleaner bag. Thus, a typical soil to be vacuumed includes particles ranging in size from submicron particles to over 1,000 microns, and would also include nonparticulate debris, e.g., threads, paper, food residues and small articles. Accordingly, the vacuum cleaner bags of the present invention had to be tested with regard to typical soils. Moreover, it was yet necessary to ensure that the vacuum cleaner bags of the present invention could efficiently remove those soil particles less than 10 microns in size.

Secondly, there was a concern that the low air permeability of the flashspun sheet would adversely affect vacuuming efficiency. A conventional paper vacuum cleaner bag initially has an air permeability of above about 25 cfm/ft$^2$, which decreases during the vacuuming operation. Moreover, as the bag fills, the surface area of the bag decreases. The decrease in air permeability and the loss in bag surface area eventually result in loss of air flow through the vacuum cleaner and into the bag. As a result, the volumetric flow of air through the vacuum, and hence the efficiency of vacuuming, decreases, notwithstanding continued vacuum motor operation. Eventually, when the pressure drop is too great, the vacuum automatically shuts off. The lack of vacuuming efficiency is usually noticeable long before this occurs and often before a paper vacuum bag is full, the user observing the inability of the vacuum to pick up threads, lint, food crumbs and small articles.

Thus, there was a serious concern that the above-described loss in vacuuming efficiency would occur long before the vacuum cleaner bag of the present invention was full. Moreover, there was a concern that the low air permeability would overtax the motor, with resultant shut-off of the vacuum and possibly mechanical problems.

Accordingly, extensive tests were carried out for the vacuum cleaner bags of the present invention. In addition, a Hoover vacuum cleaner bag and a vacuum cleaner bag made from meltblown polypropylene were also tested. The results of these tests are indicated in the Examples which follow.

The vacuum cleaner bags tested were made from substrates described in Table IV. All of the bags were tested using a Hoover upright vacuum cleaner Model No. U-3335 having a top fill vacuum inlet tube connection, which was purchased new at the commencement of the tests.

TABLE IV

| Fiber/Sheet Property | Substrate | | | | |
|---|---|---|---|---|---|
| Designation | P-16 | P-161 | R-70 | FMB | Hoover |
| Source | Dupont | Dupont | Dupont | James River | Hoover |
| Type (see notes below) | (1) | (1) | (2) | (3) | (4) |
| Fiber Characteristics: | | | | | |
| Diameter Distribution, μ | 0.5–20 | 1–20 | 0.5–40 | 10–20 | 19–40 |
| Length (mean), mm | 0.9 | 0.9 | 1.5 | Long and continuous | 1.1 |
| Surface Area, m$^2$/g | 4 | 4 | 1.5 | 1 | 0.25 |
| Sheet Characteristics: | | | | | |
| Effective Pore Size Distribution, μ: | | | | | |
| Maximum | 20.9 | 22.5 | 27.5 | 25 | 69.3 |
| Mean | 7 | 9.0 | 12.8 | 13 | 18.5 |
| Minimum | 4.3 | 6.7 | 8.2 | 8 | 9.6 |
| Caliper, mil | 9 | 10 | 11 | 20 | 6 |
| Air Permeability, cfm/ft$^2$ | 5 | 9 | 20 | 23 | 25 |
| Tongue Tear, lb/in | 0.16 | 0.2 | 0.23 | 0.06 | 0.09 |
| Mullen Burst Strength, psi | 30 | 35 | 25 | 20 | 25 |
| Surface Coefficient of Friction, Degrees | 35 | 37 | 41 | >100 | 55 |

Notes to Table IV:
(1) Flashspun polyethylene sheet per the present invention.
(2) Flashspun polyethylene sheet per the present invention containing 20% spunbonded polyester fibers having a fiber diameter up to 40μ. Composite fiber surface area is specified.
(3) Fine meltblown (FMB) polypropylene web laminated to a single spunbonded polypropylene scrim.
(4) Hoover vacuum cleaner bag, Type A.

EXAMPLE 1

Vacuum cleaner bags made with the substrates identified in Table IV were tested in accordance with ASTM F 608, which measures Pickup Efficiency of a defined test soil, which sets forth a systematic procedure for assessing vacuum cleaner performance. Applicants measured vacuum cleaner performance by measuring Pickup Efficiency, which is defined as the weight of the test soil retained in the vacuum cleaner divided by the total weight of the soil deposited uniformly onto a 6-foot by 4-foot medium shag carpet, multiplied by 100. The weight of the soil picked up by the vacuum cleaner is obtained by taking the tare weight of the vacuum cleaner before and after use.

The ASTM procedure defines generally how the carpet is to be vacuumed, but does not state the length of the vacuuming operation, nor the number of runs (e.g., number of soil applications or "soilings") to be sequentially conducted. In the tests conducted, it was found that the vacuuming of the carpet could be completed satisfactorily according to the ASTM procedure in about one minute. The test was conducted consecutively eight times. The Pickup Efficiency reported below is based on the tare weights for each of the eight trials. In each trial 100 grams of the test soil was deposited on the carpet. The test soil is specified in Table V.

TABLE V

| ASTM Test Soil Composition | Weight % |
|---|---|
| Silica Sand, μ: | |
| >420 | 0.9 |
| 300–419 | 31.5 |
| 210–299 | 41.4 |
| 149–209 | 13.5 |
| 105–148 | 2.7 |
| Talc, μ: | |
| >44 | 0.05 |
| 20–43.9 | 1.25 |
| 10–19.9 | 2.7 |
| 5–9.9 | 2.3 |
| 2–4.9 | 2.0 |
| 1–1.9 | 0.8 |
| <0.9 | 0.9 |

Approximately 8.7% of the soil comprised particles less than 20 μ. Approximately 6% comprised particles less than 10 μ.

The results of these tests are reported in Table VI.

TABLE VI

| Soil Application Number | Pickup Efficiency, %: | | | | |
|---|---|---|---|---|---|
| | P-16 | P-161 | R-70 | FMB | Hoover |
| 1 | 100.26 | 100.48 | 99.06 | 88.51 | 98.08 |
| 2 | 99.3 | 99.35 | 98.89 | 93.28 | 98.36 |
| 3 | 98.8 | 98.41 | 99.08 | 96.39 | 98.20 |
| 4 | 98.7 | 98.94 | 98.91 | 95.99 | 98.46 |
| 5 | 98.4 | 98.31 | 98.68 | 96.30 | 98.70 |
| 6 | 98.99 | 98.04 | 98.75 | 96.28 | 98.03 |
| 7 | 99.1 | 97.90 | 98.46 | 96.78 | 97.84 |
| 8 | 99.01 | 97.90 | 98.79 | 93.81 | 98.53 |

This data indicates that the efficiency of the vacuum cleaner bags made with each of the materials maintained their Pickup Efficiency during the course of the eight trials, although the Pickup Efficiency of the fine meltblown mateiral was somewhat less. The bag made from the R-70 sheet also performed quite well.

EXAMPLE 2

The test of Example 1 was repeated using a simulated household soil (SHS), as described in Table VII.

TABLE VII

| SHS Composition | Particle Size | Weight % |
|---|---|---|
| Fine Dust | See below | 6.5 |
| 16 Mesh Sand | 1190μ | 8.0 |
| 20 Mesh Sand | 841μ | 5.0 |
| 40 Mesh Sand | 420μ | 15.0 |
| 70 Mesh Sand | 210μ | 10.0 |
| Talc | Per Table V | 6.5 |
| Oats and Rice | | 5.0 |

TABLE VII-continued

| | |
|---|---|
| Crackers | 3.0 |
| Thread | 3.0 |
| Paper | 4.0 |
| Yarn | 1.0 |
| Cotton Linters | 33.0 |
| Total | 100.0 |
| Fine Dust Particle Size Distribution | |
| Nominal Particle Size, μ | Cumulative Percent |
| <5.5 | 38 |
| <11.0 | 54 |
| <22.0 | 71 |
| <44.0 | 89 |
| <176.0 | 100 |

This soil was developed by analyzing typical soil samples in vacuumed carpets. Approximately 7.4% of the soil comprises soil particles less than 10 μ.

The results of this test are tabulated below in Table VIII.

TABLE VIII

| Soil Application Number | Pickup Efficiency, % | | | |
|---|---|---|---|---|
| | P-16 | P-161 | FMB | Hoover |
| 1 | 91.20 | 89.6 | 88.51 | 87.9 |
| 2 | 92.0 | 93:9 | 93.28 | 91.1 |
| 3 | 95.80 | 93.1 | 96.39 | 94.1 |
| 4 | 96.40 | 94.4 | 95.99 | 94.0 |
| 5 | 94.70 | 94.8 | 96.30 | 95.1 |
| 6 | 94.80 | 95.0 | 96.21 | 96.8 |
| 7 | 96.40 | 96.9 | 96.78 | 96.6 |
| 8 | 93.00 | 99.6 | 93.82 | 98.4 |

These results confirm the conclusions reached with respect to Example 1, that is, the tested vacuum cleaners are capble of picking up a composite soil containing mostly large-sized debris.

EXAMPLE 3

Pickup Efficiency as measured in Examples 1 and 2 is seen to be a measure of the vacuum cleaner to pick up dirt. As such it is more a measure of the vacuum cleaner's suctioning capacity than the particle capture efficiency of the vacuum cleaner bag. Thus, the procedure used in Examples 1 and 2 is suitable to determine the overall effectiveness of the vacuum cleaner bag in removing a soil from a vacuumed surface, but does not adequately consider the ability of the vacuum bag to retain small particles.

Thus, the procedure of Examples 1 and 2 includes in the dirt picked up small amounts of dirt not present in the vacuum cleaner bag. Such small amounts of dirt would be found, for example, in the vacuum inlet nozzle and vacuum inlet tube connection, as well as dirt passing through the vacuum bag but retained in the permanent outer bag present on the vacuum cleaner.

Moreover, the procedure, although satisfactory in establishing overall trends, is subject to appreciable error in the accurate measurement of Pickup Efficiency. This is so because the procedure measures the weight of the test soil retained in the vacuum cleaner by obtaining the tare weight of the vacuum cleaner before and after vacuuming of the test soil. In view of the large mass of the vacuum cleaner as compared to the weight of the dirt picked up, the procedure is quite insensitive, especially since the total weight of the particles less than 10 μ is only 6 g in the case of the ASTM soil and about 7.4 g in the case of the SHS soil.

Accordingly, the ASTM procedure was modified as follows. A Climet particle analyzer Model No. CI-7300 was used to measure the particle size population of the air exhausted from the vacuum. The analyzer was set to determine in the exhaust the number of particles >0.3, >0.5, >0.7, >1.0, >5.0 and >10.0 microns. The analyzer inlet nozzle was located approximately two feet from the exhaust of the vacuum cleaner. For an upright vacuum, the exhaust was considered to be that portion of the outer vacuum bag proximate the vacuum inlet tube connection. The analyzer provided a printout of the number of particles of the above-identified distribution automatically every minute.

Care was taken during the application of the test soil to the carpet to prevent contaminating the air in the room where the test was conducted. Sufficient time was given after application of the soil to the carpet to allow any airborne soil particles to settle. Vacuuming was commenced when the analyzer printout recorded a background population of 250 particles of >10.0 microns. As in Examples 1 and 2, the carpet was vacuumed for one minute. Thus, the end of vacuuming coincided with the analyzer printout for the next one-minute interval. The difference between this analyzer reading and the background analyzer reading for each particle size were calculated. It should be recognized that, although the particle size analyzer operated continuously, the particle size measurements are not instantaneous but, rather, are integrated with time over the one-minute interval prior to the printout. Vacuum cleaner bugs made from the P-16, P-161, FMB and Hoover materials were tested as described above. The SHS soil was used in the test.

Figure 6:
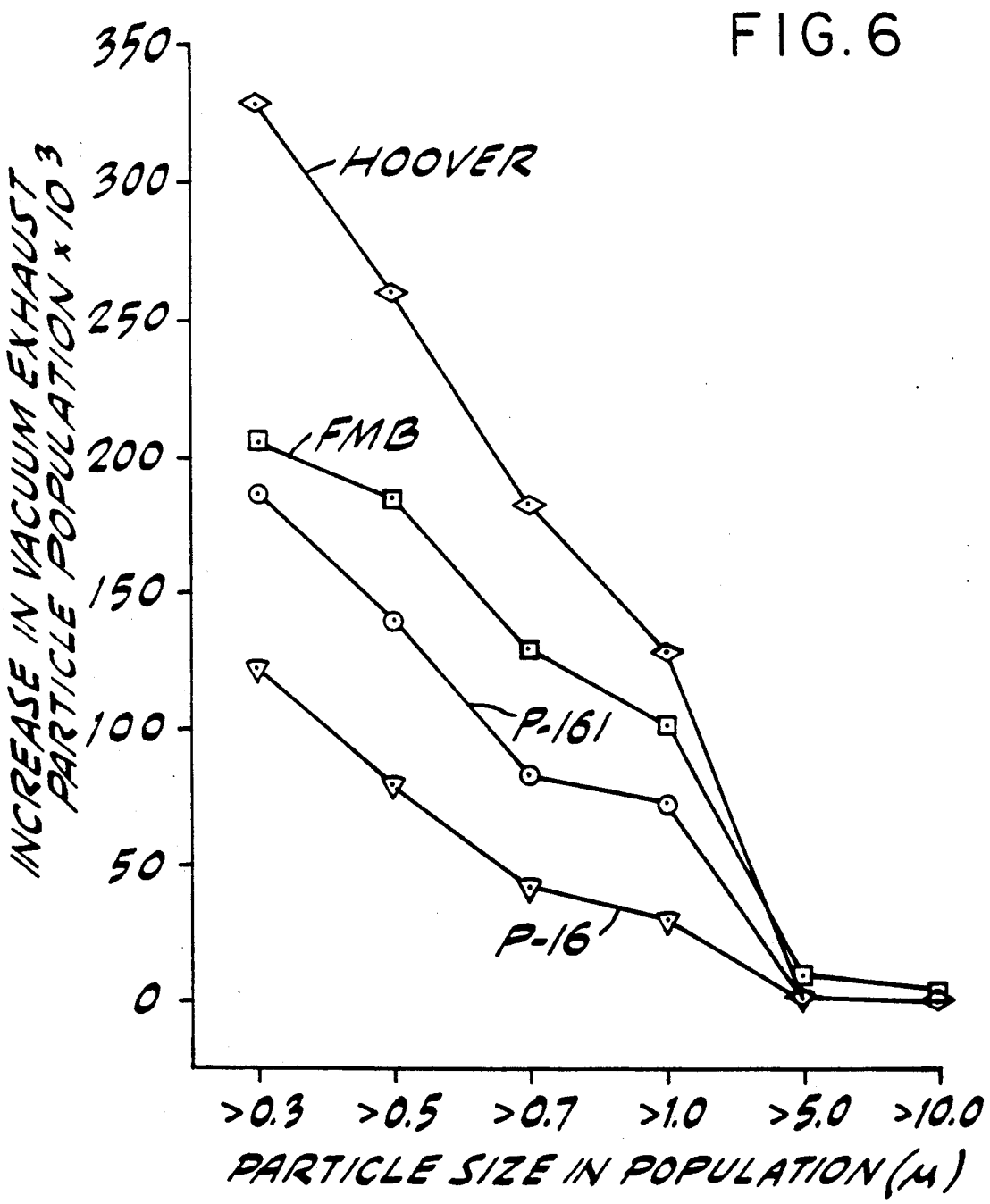
FIG. 6 is a graph illustrating the increase in the number of particles exhausting the vacuum as a function of particle size of a given population, for various vacuum cleaner bags.

The results are illustrated graphically in FIG. 6. Except for the fine meltblown vacuum cleaner bag, these results are the average of two separate runs using a new vacuum cleaner bag on each run, the separate runs being the average of eight sequential trials. The results for the fine meltblown are based on a single run of eight averaged sequential trials. In each trial the soil applied to the carpet was 100 grams.

Figure 7:
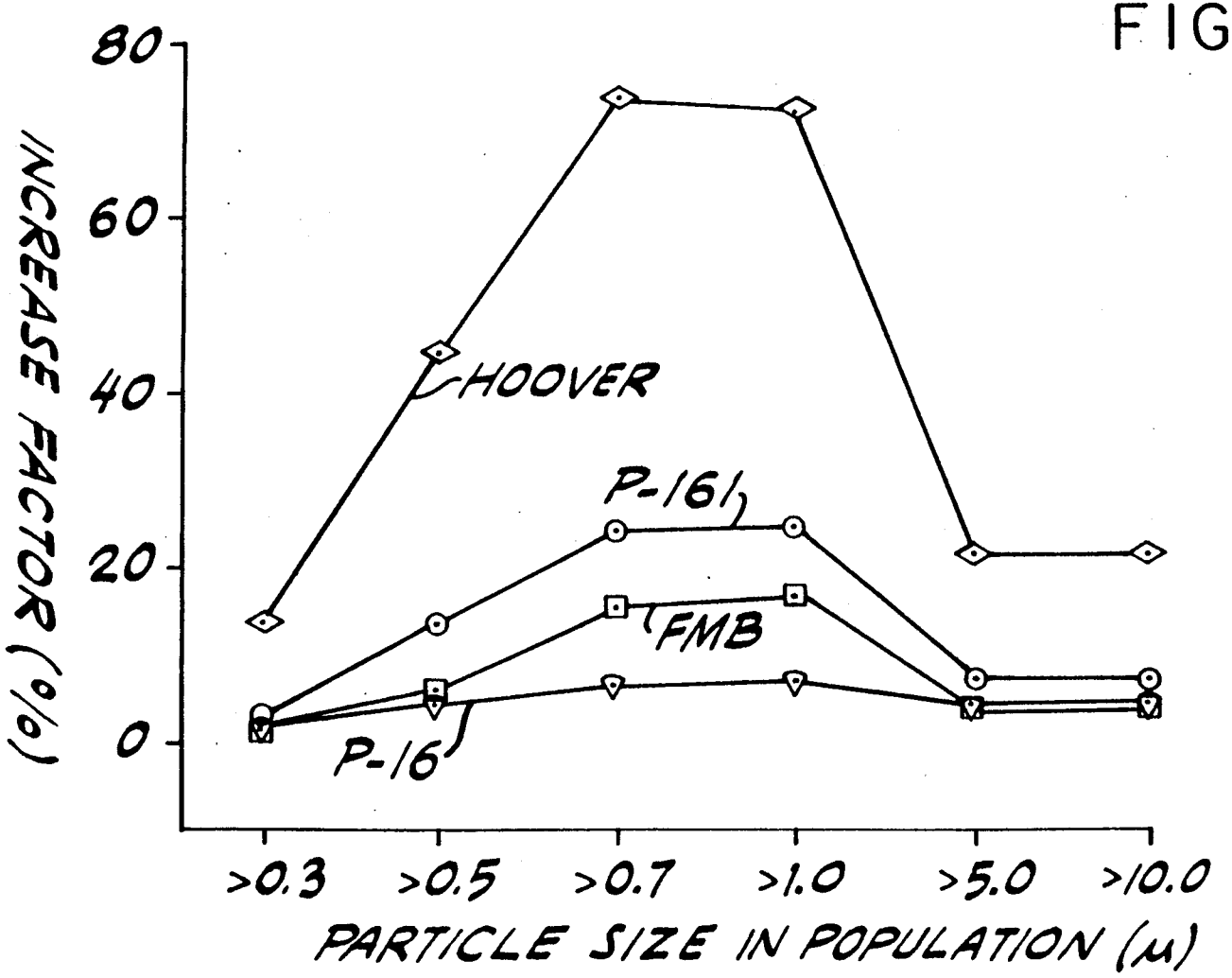
FIG. 7 is a graph of Increase Factor, defined in Example 5, as a function of particle size of a given population, for various vacuum cleaner bags.

FIG. 7 illustrates these test results as the percentage increase ("Increase Factor") of particles of a given size distribution present in the vacuum exhaust over the background level for the given size distribution, i.e., $$\textit{Increase Factor} = [(P_v - P_i)/P_i]_n \times 100$$

where $P_v$ = the population of particles reported at the end of vacuuming;

$P_i$ = the population of particles reported in the background measurement, and n = the given particle size, e.g., >0.3, >0.5, etc.

Increase Factor is thus a measure of the increase in the number of particles of a particle size distribution that became airborne by virtue of vacuuming. It is seen from FIG. 6 that vacuuming with a conventional paper vacuum cleaner bag increased the <5 micron-sized particles present in the exhaust substantial, while the P-16 and P-161 cleaner bags of the present invention greatly lowered such sized particles present in the exhaust. FIG. 7 shows that relative to paper the reduction in the smaller particles is significant. FIG. 7 also shows that the fine meltblown material was efficient in preventing the airborne particles from exhausting to the atmosphere. However, in testing the vacuum cleaner bags beyond the eight sequential soilings per this Example, it was found that this fine meltblown bag, as well as others, was particularly prone to various types of problems. Typically, the bag failed long before the bag was full. The results of such testing is reported in Example 5.

EXAMPLE 4

The vacuum cleaner bags of the present invention were tested subjectively for their ability to capture fine dust particles. In this test 10 grams of Fine Dust (described in Example 2) were applied to the carpet. About 3.5% of this soil is less than about 10 μ. After allowing the dust to settle, the soil was vacuumed. With the lights in the room off and blinds drawn, a 500-watt spotlight was focused on the exhaust, in order to observe any particles passing through the vacuum bag. In addition, the vacuum bags made of paper and fine meltblown polypropylene described in Table IV were tested. Finally, a Rainbow vacuum was tested. The Rainbow machine, which is used by professional cleaning services, employs a water filtration cartridge to entrap dust particles, and is reported to be exceptionally efficient in doing so.

The results of the tests are reported in Table IX, wherein a rating of 1 to 10 was assigned to the observed exhaust. A rating of 1 represented an exhaust having essentially no observable entrained dust particles, while a rating of 10 was arbitrarily assigned to the Hoover bag. All tests were conducted with the vacuum used in the previous examples, except for the test of the Rainbow machine.

TABLE IX

| Vacuum Cleaner Bag | Rating | Comments |
|---|---|---|
| Hoover Bag | 10 | Quite visible cloud of dust. |
| P-161 | 1 | No visible dust. |
| P-16 | 1 | No visible dust. |
| R-70 | 2 | Traces of dust visible. |
| FMB | 10 | Quite visible cloud of dust. |
| Rainbow | 4–5 | Visible dust passing through seal on machine. |

EXAMPLE 5

Vacuum cleaner bags fabricated from various materials, as described in Table IV or in Footnotes 1–6 of Table X, were tested for suitable normal use by vacuuming sequentially applied soils until the bag was full or vacuuming was otherwise impaired. Three different soils were used in these tests, the ASTM soil described in Table V, the SHS soil described in Table VII, and a soil containing 10 grams fine dust (per table VII) and 20 grams lint (Soil A). When the ASTM and SHS soils were used, 100 grams of the soil were applied in each sequential application. When Soil A was used, only 30 grams of the soil was applied each time. The results of these tests are reported below in Table X. Dust present in the exhaust was observed as in Example 4.

TABLE X

| Test No. | Vacuum Cleaner Bag | Soil | No. Soil Applns. | Total Amount Soil Collected, g | Comments |
|---|---|---|---|---|---|
| 1 | Hoover | A | 36 | 1035 | Appreciable dust penetration throughout test. Bag full; soil loosely compacted. |

TABLE X-continued

| Test No. | Vacuum Cleaner Bag | Soil | No. Soil Applns. | Total Amount Soil Collected, g | Comments |
|---|---|---|---|---|---|
| 2 | R-70 | A | 55 | 1516 | Some dust penetration through bag was observed up to soil No. 41. Bag full. |
| 3 | R-70 | A | 56 | 1680 | Bag inlet orifice reinforced with P-16 material. Some dust observed proximate orifice for first five soil applications. Bag full. |
| 4 | P-16 | A | 76 | 2196 | Very slight dust penetration observed, which continued to soil No. 35. Bag full; soil tightly compacted. |
| 5 | P-161 | SHS | 25 | 2402 | No visible dust observed during vacuuming. No loss in vacuum pickup capacity during test. Bag full; soil tightly compacted. |
| 6 | Hoover | SHS | 24 | 2266 | Appreciable dust visible during first several soil applications. Bag full. |
| 7 | Spunbonded[1] | SHS | 2 | — | Overwhelming amount of dust penetrating bag. Test discontinued after two soil applications. |
| 8 | Spunbonded[2] | SHS | 1 | — | Clay coating began to delaminate after first soil application. Test was discontinued. |
| 9 | Meltblown[3] | SHS | 11 | 1054 | Visible dust penetration across inlet orifice. Loss of pickup capacity observed during 11th soil removal. Test discontinued. |
| 10 | Meltblown[4] | SHS | — | — | Plies of material could not be adhesively affixed. Not tested. |
| 11 | Creped Paper[5] | SHS | 20 | 1788 | Little visible dust penetration. Loss of pickup capacity during 18th soil application. Bag had begun to delaminate. Bag full; soil not compact. |
| 12 | FMB | ASTM | 8 | 683 | Bag burst open and test was discontinued. |
| 13 | FMB | ASTM | 2 | — | Side seam split during second soil application. |
| 14 | FMB | ASTM | 2 | — | Tremendous amount of dust observed penetrating bag during first soil application. Side seam burst during second soiling. |
| 15 | Meltblown[6] | ASTM | 2 | — | Visibile dust penetration on first soiling, less on second. Side seam burst during first soil application. |

(1)Spunbonded polyester web from Reemey Corp. Basis weight 6 oz.; 140 cfm/ft$^2$.
(2)Same vacuum bag materials as in Footnote 1 above, but coated with 3 oz. clay; 12 cfm/ft$^2$.
(3)Meltblown polypropylene web of 22 cfm/ft$^2$ from James River Company and processed to electrically charge fibers. One scrim of lightweight spunbonded polypropylene.
(4)Meltblown polypropylene web from James River Company that had been calendered to reduce air permeability to about 10 cfm/ft$^2$.
(5)Micro creped paper material of 15 cfm/ft$^2$ from Pepperal Division of James River Company.
(6)Meltblown polypropylene per Table IV, but thermally bonded. Bag fabricated with support scrim of spunbonded polypropylene.

The Hoover bag was adequate in picking up the soil, although dust passing through the bag was a problem. The vacuum cleaner bags of the present invention were very efficient in this regard. Moreover, it was surprising that the P-161 and P-16 bags picked up a substantially greater amount of soil. This is because the soils were much more compact within the bag. None of the other bags tested performed adequately. In particular, bags made of the meltblown material were found to lack the structural integrity necessary for the vacuuming operation.

EXAMPLE 6

In order to determine if the vacuum cleaner bags of the present invention deleteriously affected vacuum motor performance, a P-161 bag and a Hoover bag were tested as in Example 2. During the test, a sound analysis of the motor was made using a Quest 215 sound level meter, Model Type 2-1EC. No difference was found in the sound analysis as between these two bags.

EXAMPLE 7

A further test was conducted using a P-161 vacuum cleaner bag of the present invention. The vacuum cleaner bag was soiled with fine dust (0.0023 oz. per sq. in. of primary filtering area) by vacuuming the dust through the intake port at a rate of 0.07 oz. per minute. The cleaner inlet tube was then plugged into a solenoid controlled plate which cycled open for 7.5 seconds and closed for 7.5 seconds. The vacuum was operated in this manner continuously for 12 hours. No negative effect was observed for either the bag or the vacuum.

What is claimed is:

1. A vacuum cleaner bag suitable for use with a vacuum cleaner having a vacuum inlet tube attachable at one end to said vacuum cleaner bag, the vacuum cleaner bag comprising a closed receptacle having a vacuum inlet tube attachment orifice, said receptacle being formed from a sheet containing at least 65% ultra-short, micro-fine flashspun polyolefin fibers, and means affixed to said receptacle for attachment of the vacuum inlet tube within the orifice.

2. The vacuum cleaner bag of claim 1 wherein the flashspun polyolefin sheet has a pair of opposed lateral edges and a pair of opposed transverse edges, the receptacle being formed by affixing surfaces proximate said opposed lateral and said opposed transverse edges.

3. The vacuum cleaner bag of claim 1 wherein the sheet contains less than about 25% of nonflashspun fibers by weight of the sheet.

4. The vacuum cleaner bag of claim 3 wherein the nonflashspun fibers present in the sheet are less than about 10% by weight of the sheet.

5. The vacuum cleaner bag of claim 1 wherein the sheet contains essentially 100% flashspun polyolefin fibers.

6. The vacuum cleaner bag of claim 1, 3 or 5 wherein the flashspun sheet has an air permeability of from about 2 to about 20 cfm/ft$^2$.

7. The vacuum cleaner bag of claim 6 wherein the flashspun sheet is fabricated from flashspun fibers having a fiber diameter distribution in the range of from about 1 to 20 microns, a fiber length of from about 0.1 to about 6 mm, and a fiber surface area of from about 2 to 6 m$^2$/g, the sheet having a caliper of from about 5 to 25 mil.

8. The vacuum cleaner bag of claim 7 wherein the flashspun sheet has an effective pore size distribution on a cumulative percent basis essentially as follows: $1\% > 30\ \mu$, $5\% > 20\ \mu$, $90\% > 10\ \mu$, and $100\% < 10\ \mu$ and above.

9. The vacuum cleaner bag of claim 8 wherein the flashspun polyolefin fibers are selected from polyethylene and polypropylene.

10. The vacuum cleaner bag of claim 8 wherein the air permeability of the flashspun sheet is from about 5 to about 12 cfm/ft$^2$.

11. A vacuum cleaner bag suitable for use with a vacuum cleaning device having a vacuum inlet tube attachable at one end to the vacuum cleaner bag, the vacuum cleaner bag comprising a closed receptacle having a vacuum inlet tube attachment orifice, and means to support the vacuum inlet tube within said orifice, said receptacle being fabricated from a sheet containing at least 75% ultra-short, micro-fine flashspun polyolefin fibers, the sheet being of such strength as not to require further structural support means and of sufficient durability as to resist undue wearing during normal vacuuming, the vacuum cleaner bag retaining sufficient air permeability during vacuuming to maintain its cleaning capability until the vacuum cleaner bag is essentially full.

12. The vacuum cleaner bag of claim 11 wherein the flashspun polyolefin fibers present in the sheet have a fiber diameter distribution in the range of from about 1 to 20 microns, a fiber length of from about 0.5 to 6 mm, and a fiber surface area of from about 2 to 6 m$^2$/g, the caliper of said sheet being from about 5 to 20 mil.

13. The vacuum cleaner bag of claim 12 wherein the air permeability of the sheet is from about 2 to about 20 cfm/ft$^2$.

14. The vacuum cleaner bag of claim 13 wherein the sheet includes nonflashspun fibers in an amount of less than 10%.

15. The vacuum cleaner bag of claim 13 wherein the flashspun fiber sheet contains essentially 100% flashspun fibers.

16. The vacuum cleaner bag of claims 11, 13, 14 or 15 wherein the flashspun sheet has an effective pore size distribution on a cumulative percent basis essentially as follows $0.1\% > 30\ \mu$, $2\% > 20\ \mu$, $50\% > 10\ \mu$, and $100\% < 10\ \mu$ above.

17. The vacuum cleaner bag of claim 16 wherein the air permeability of the flashspun sheet is from about 5 to about 12 cfm/ft$^2$.

18. The vacuum cleaner bag of claim 17 wherein the flashspun polyolefin fibers present in the sheet are selected from polyethylene and polypropylene.

19. The vacuum cleaner bag of claim 18 wherein the flashspun fibers have a fiber diameter distribution in the range of from about 0.5 to 10 microns, a fiber length of from about 0.5 to 2 mm, and a fiber surface area of from about 3.5 to 6 m$^2$/g, the caliper of the sheet being from about 8 to about 15 mils.

20. The vacuum cleaner bag of claims 11, 14 or 15 wherein the flashspun polyolefin fibers present in the sheet are polyethylene.

21. The vacuum cleaner bag of claim 11 wherein the receptacle is fabricated from a sheet that is a single ply.

22. The vacuum cleaner bag of claim 11 wherein the receptacle is fabricated from a sheet that is two-ply.

23. A method of vacuuming a surface to be cleaned comprising attaching the vacuum cleaner bag of claim 1 or 11 to a vacuum inlet tube in a vacuuming cleaning device, and vacuuming said surface.

24. The method of claim 23 wherein the vacuum cleaning device is an upright or canister vacuum cleaner.

25. The method of claim 23 wherein the vacuum cleaning device is a central vacuum cleaning system.

26. The method of claim 23 wherein the vacuum cleaner bag is capable of reuse, the method further comprising the steps of removing the vacuum bag, emptying the vacuum bag of soil removed from the vacuumed surface, and reattaching the vacuum bag to the vacuum inlet tube.

* * * * *